United States Patent [19]

Ullrich

[11] 4,227,474

[45] Oct. 14, 1980

[54] CATAMARAN EQUIPPED WITH RE-RIGHTING DEVICE

[76] Inventor: Gunter Ullrich, Regenwalderweg 36, 1 Berlin 27, Fed. Rep. of Germany

[21] Appl. No.: 914,650

[22] Filed: Jun. 12, 1978

[30] Foreign Application Priority Data

Jun. 13, 1977 [DE] Fed. Rep. of Germany ..... 2727074

[51] Int. Cl.[3] ..... B63B 1/00

[52] U.S. Cl. ..... 114/61; 114/39; 114/68

[58] Field of Search ..... 114/39, 52, 61, 68, 114/69, 121, 122, 123, 124, 125

[56] References Cited

U.S. PATENT DOCUMENTS

| | | | |
|---|---|---|---|
| 3,282,238 | 11/1966 | Tucker | 114/52 |
| 3,418,959 | 12/1968 | Tanner et al. | 114/124 |
| 3,503,358 | 3/1970 | Moesly | 114/125 |
| 3,504,651 | 4/1970 | Halden et al. | 114/125 |
| 3,910,214 | 10/1975 | Holter | 114/61 |

FOREIGN PATENT DOCUMENTS

| | | | |
|---|---|---|---|
| Ad.4718 | of 1913 | United Kingdom | 114/61 |

OTHER PUBLICATIONS

Multihulls, Fall/76, "Symposium in Toronto, Canada, in Summer 1976", pp. 24 and 26.

*Primary Examiner*—George E. A. Halvosa
*Attorney, Agent, or Firm*—Allison C. Collard; Thomas M. Galgano

[57] ABSTRACT

A catamaran is provided which is equipped to permit facile re-righting thereof after capsizing. The catamaran includes floodable forecastles and buoyancy chambers, and a watertight cabin in the stern separated by bulkheads from the forecastles. Air inlets are provided for introducing compressed air into the buoyancy chambers to effect re-righting of the catamaran.

2 Claims, 2 Drawing Figures

CATAMARAN EQUIPPED WITH RE-RIGHTING DEVICE

Figure 1:
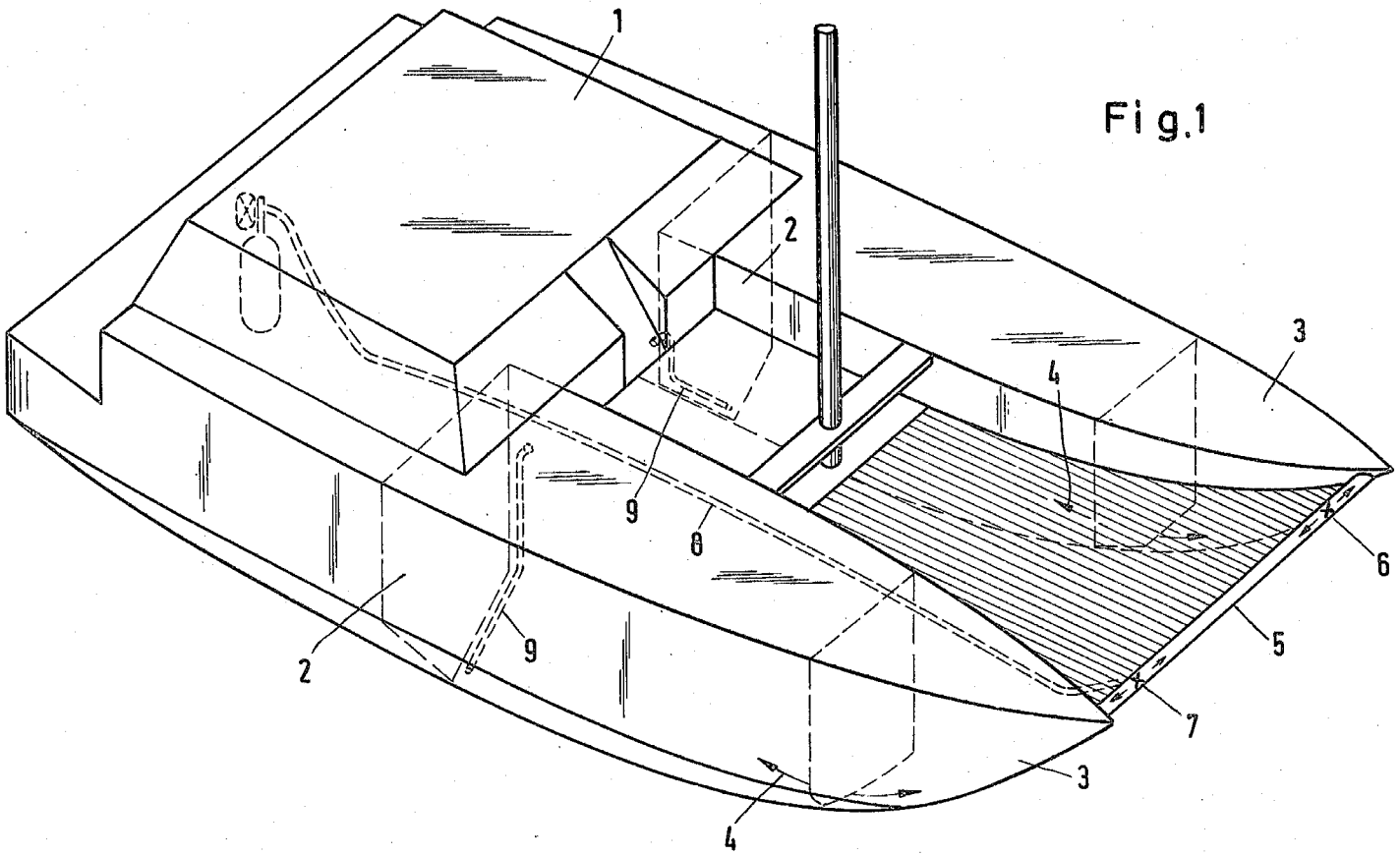

The invention relates to a cruiser-catamaran which, after capsizing, may be righted by flooding the forecastle which is partitioned off by bulkheads, and by using compressed air.

Methods for the re-righting of a capsized cruiser-catamaran are known, one of which provides a buoyancy device in the masthead which prevents complete capsizing of the cruiser-catamaran. An A-frame is provided at the center of the lower bridge-deck of the catamaran lying on its side. At the top of the A-frame is fastened a water-filled ballast-sack. This ballast, cooperating with the levering action of the A-frame is supposed to re-righten the catamaran along its longitudinal axis ("Yacht" #10/72 page 52).

In another method, an A-frame with a waterballast is fastened as aforedescribed to the boat which now stands vertical due to flooding of the forecastle, and a winding tackle connects the top of the A-frame with the stern. The tackle is then hauled in by a winch until the catamaran rights itself along its transverse axis ("Multihulls" Fall '76, page 24).

These methods appear rather questionable and do not appear likely to be put into practice as they demand strenuous and difficult labor during heavy seas.

Accordingly, it is the object of the present invention to provide a catamaran having a device which facilitates the re-righting thereof in difficult situations without physical labor.

This object is achieved according to the invention, by the provision of a catamaran which is characterized, in contradistinction to conventional boats, by the provision of forward hulls having floodable forecastles and buoyancy chambers disposed forwardly of the forecastles and communicating therewith, a watertight cabin disposed in the stern of the catamaran and separated from the forecastles by bulkheads and an openable and closable inlet for introducing compressed air into the buoyancy chambers.

Preferably, the compressed air inlets are arranged at the anterior end of the buoyancy chambers. Most advantageously, the catamaran includes simultaneously actuable flooding means for flooding the forecastles and buoyancy chambers.

Other objects and features of the present invention will become apparent from the following detailed description when taken in connection with the accompanying drawings which discloses one embodiment of the invention. It is to be understood that the drawings are designed for the purpose of illustration only and are not intended as a definition of the limits and scope of the invention disclosed.

In the drawings, wherein similar reference numerals denote similar elements throughout the several views.

Figure 2:
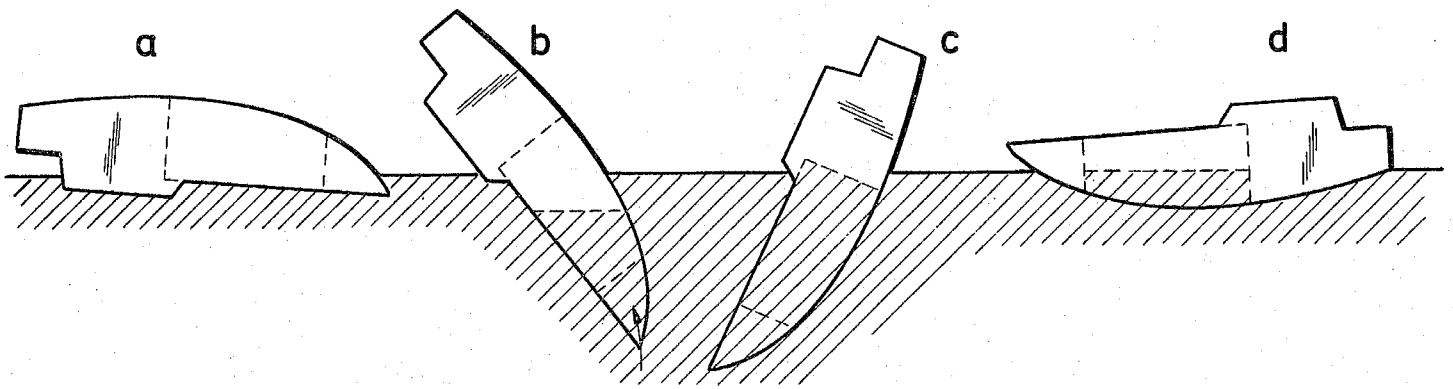

FIG. 1 is a perspective view of a catamaran embodying the present invention; and FIG. 2 schematically illustrates in steps a, b, c, and d, the individual phases of the re-righting process.

Referring now to FIG. 1, therein illustrated is a catamaran having a watertight cabin 1 located in the rearward half of the boat. Cabin 1 is provided with a hatch on its bottom in order to provide an escape outlet after capsizing. The side hulls are connected with cabin 1 within the area of cabin 1, which cabin is bulkheaded tightly against the entrance of water by means of bulkheads 2.

The anterior bulkhead pressure spaces 3 are formed to create buoyancy chambers which are calculated to have the correct volume in relation to the size of the boat in order to create sufficient buoyancy and are connected to the rest of the forecastles only in the areas of the bilge 4.

Buoyancy chambers 3 are connected at the bow by a pipe 5 which is provided with a flooding valve 6. Valve 6 is capable of being actuated within cabin 1. Connecting pipe 5 is also provided with an air inlet 7 coupled with a stationary or fixed conduit 8 which leads to cabin 1.

Two air vents 9 are also provided which lead from the posterior bilge area of the frontal hulls to the bridge deck.

In operation, after capsizing (FIG. 2*a*), re-righting is effected by initially opening flood valve 6. After flooding, the bow of the catamaran moves downwardly (FIG. 2*b*) due to the buoyancy of the posterior part and the weight relations governing the boat. The move of the bow amounts to about 130° around its transverse axis (FIG. 2*c*) and the captured air escapes through both air vents 9. Then flood valve 6 are closed and air is introduced into the anterior buoyancy chambers. The bow lifts and the water streams out of the anterior hulls. The catamaran rests now almost in its natural position (FIG. 2*d*). Leftover water may be removed by the crew. An experiment on a model proved the aforesaid.

The advantages obtained by the invention are: firstly, a greater chance of survival for the crew and secondly, the catamaran may be re-righted by one person without physical labor and may then go on sailing.

In contradistinction thereto, a conventional multiple hull boat must be considered lost in open sea when no outside help is near, and the chances of survival of the crew are extremely poor.

While only one embodiment of the present invention has been shown and described, it will be obvious to those persons of ordinary skill in the art that many changes and modifications may be made thereunto without departing from the spirit and scope of the invention.

What is claimed is:

1. A cruiser catamaran comprising:

forward hulls having floodable forecastles, and buoyancy chambers disposed forwardly of said forecastles and communicating therewith;

a watertight cabin disposed in the stern of said cruiser catamaran and separated from said forecastles by bulkheads;

an openable and closable inlet for introducing compressed air into said buoyancy chambers, said inlet being arranged at the anterior end of said buoyancy chambers; and simultaneously actuable flooding means for flooding said forecastles and buoyancy chambers, whereby after capsizing, re-righting may be effected by initially activating said flooding means so that said forecastles and buoyancy chambers become flooded, as a result of which the bow of the catamaran moves downwardly about 130° around its transverse axis, then the flooding means is closed and compressed air is introduced into the anterior buoyancy chambers through said inlet so as to return the bow and, in turn, the catamaran almost to its normal position.

2. The catamaran according to claim 1, additionally including two air vents for venting the floodable forecastles of captured air following flooding of the same.

* * * * *